United States Patent [19]

Edwards et al.

[11] 3,988,105

[45] Oct. 26, 1976

[54] COKE OVEN AIR REGULATING ASSEMBLY

[76] Inventors: Glenn R. Edwards, 1500 Blossom Hill Road, Pittsburgh, Pa. 15234; Howard J. Imhoff, 5406 Park Ave., Bethel Park, Pa. 15221

[22] Filed: July 7, 1975

[21] Appl. No.: 593,478

[52] U.S. Cl. ..... 431/121; 202/241

[51] Int. Cl.[2] ..... C01B 43/00

[58] Field of Search ..... 201/2; 202/241; 431/3, 431/29, 30, 31, 121, DIG. 45, DIG. 46

[56] References Cited

UNITED STATES PATENTS

| | | | |
|---|---|---|---|
| 2,227,930 | 1/1941 | Grasshoff | 202/241 X |
| 3,344,039 | 9/1967 | Nestler | 202/241 X |

*Primary Examiner*—Robert G. Nilson
*Attorney, Agent, or Firm*—William J. Ruano

[57] ABSTRACT

A coke oven decarborizing air regulating assembly comprising a manifold pipe extending along each side of a battery of coke ovens for feeding gas to a plurality of separate pipes leading to burners in the ovens, each of which pipes includes an air regulating assembly comprising a cylindrical pipe section with a plurality of holes cooperating with the edge of a relatively slidable cylindrical sleeve having an end plate or "cookie" with a handle for slidably moving the sleeve longitudinally to quickly regulate the amount of air introduced into the oven. The handle also serves as a stop element to prevent abnormal insertion of the sleeve into the pipe — also it may predetermine the normal opening of the air admitting holes.

4 Claims, 7 Drawing Figures

COKE OVEN AIR REGULATING ASSEMBLY

This invention relates to a coke oven air regulating assembly.

An outstanding disadvantage of presently used coke oven air regulating assemblies is that they require relatively large, that is, about 5 inch diameter externally threaded pipe, which must be longitudinally slotted, and which is screw threaded to an internally threaded sleeve having an end plate or "cookie" on which a bolt head is welded which is turned by a large wrench for varying the adjustment of the air openings. Such adjustment is a very slow and tedious one, involving considerable time and effort in view of the required frequency for changing the amount of air fed, such as for decarbonization of the flue wall during reversal of the air flow into the coke oven, etc.

Another disadvantage is that the above described construction is very costly to manufacture since the threading operation is time consuming and expensive and requires dressing up of the threads, since the threaded sleeve is not a stock item and requires costly operations for manufacture and for the slotting.

Another disadvantage is that when forced air is required for the coke oven, the entire threaded assembly must be taken apart and a new part substituted for introducing such forced air.

Still another disadvantage is that the screw threaded parts are not effectively locked when in the desired adjusted position.

An object of the present invention is to provide a novel coke oven air regulating assembly which is devoid of the abovenamed disadvantages of presently used assemblies and which effects considerable savings in cost of manufacture and maintenance of the assembly.

Another object of the present invention is to provide a very quick acting air regulating means for overcoming the slowness inherently involved in turning, by a large wrench, the threaded sleeve of the commonly used air regulating means for coke ovens. Usually only 15 minutes is available to adjust about 60 units, which is often difficult or impossible with existing apparatus.

Still another object of the present invention is to provide a handle formed on the end plate or "cookie" having additional purposes other than as a means for adjusting the amount of air, namely, as a limit stop against abnormal inward movement of the sleeve, as well as a fixed and rapid adjustment for normal air intake.

Other objects and advantages will become more apparent from a study of the following description taken with the accompanying drawings wherein.

Figure 1:
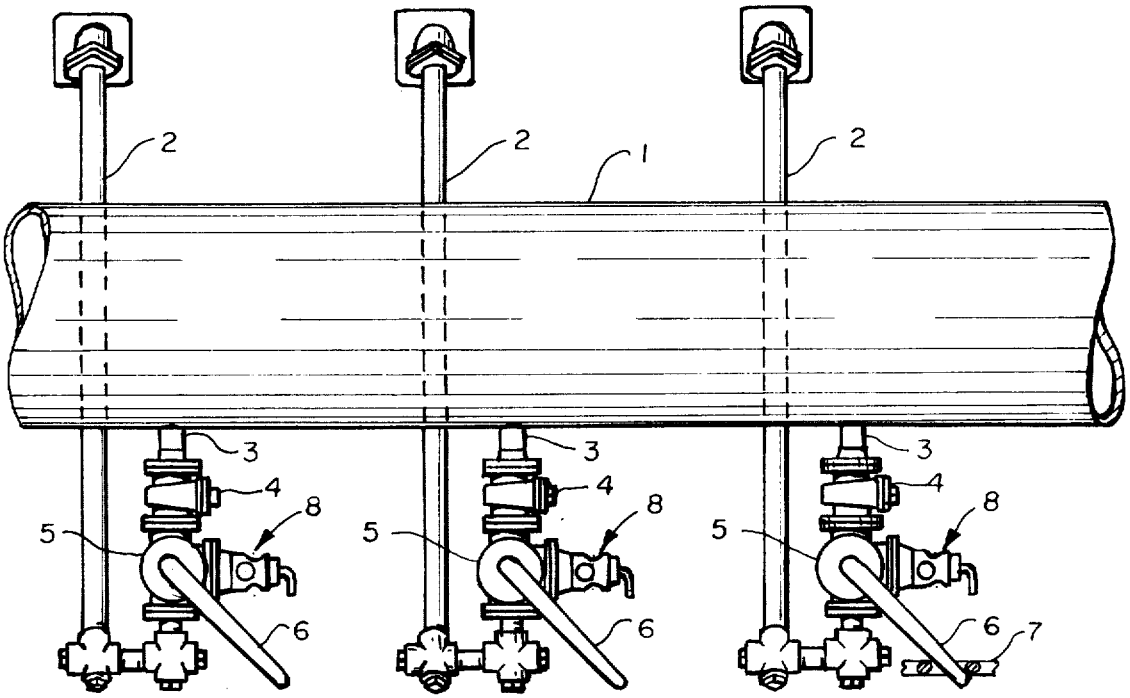
FIG. 1 is a fragmentary, elevational view of one side of a coke oven air regulating assembly embodying the principles of our invention.
Figure 2:
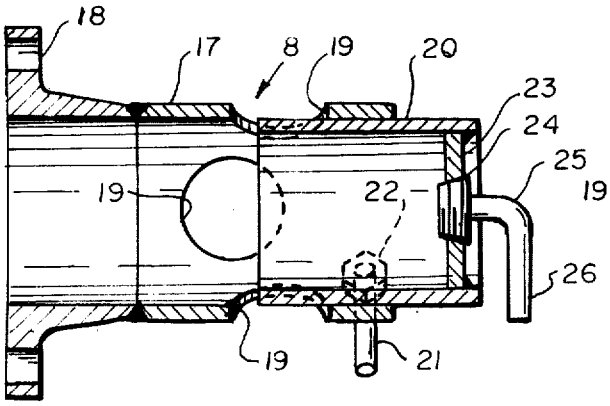
FIG. 2 is an enlarged, vertical, cross-sectional view of one of the air regulating assemblies 8 shown in FIG. 1.
Figure 4A:
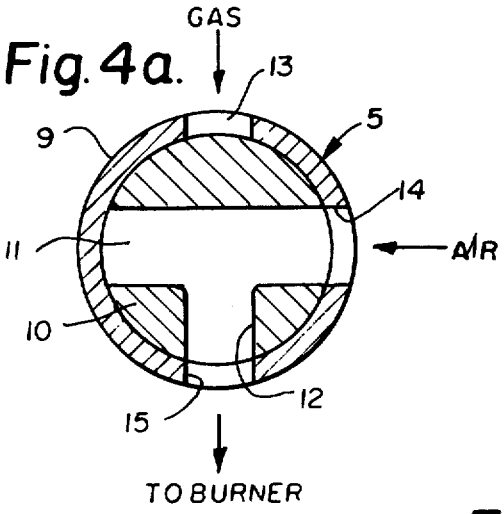
Figure 4B:
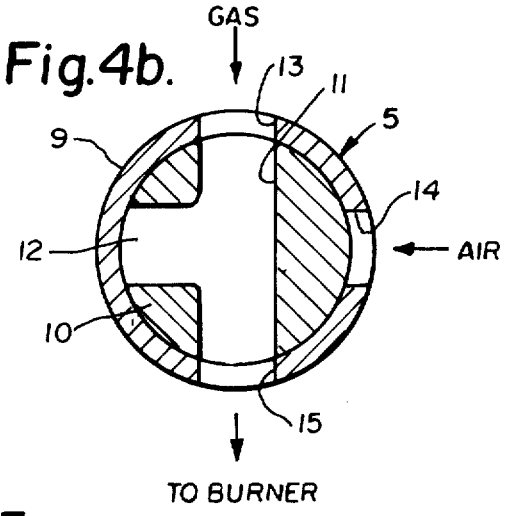
Figure 5:
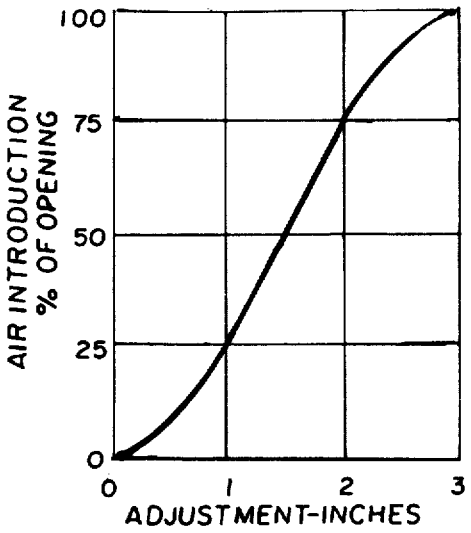
Figure 6:
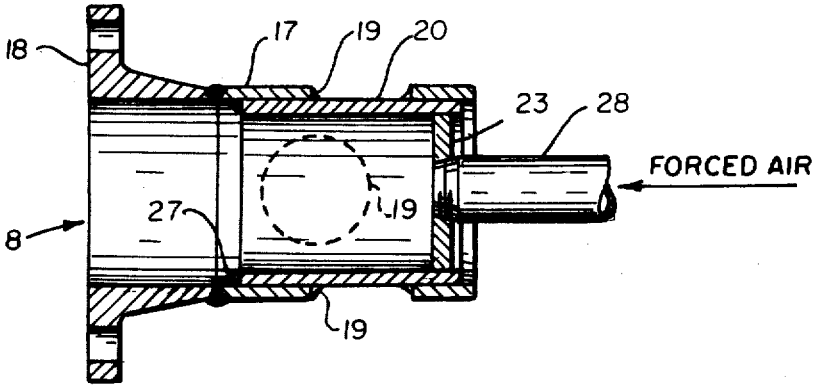

FIG. 4*a* is an enlarged, transverse, cross-sectional view of one of the three-way valves 5 shown in FIG. 1, illustrated in the air-feeding position;

FIG. 4*b* is a view similar to FIG. 4*a* except showing the valve in the gas-feeding position;

FIG. 5 is a chart showing the percentage of opening for air feed plotted against the corresponding adjustment in inches of the slidable sleeve of the air regulating assembly; and, FIG. 6 is a view similar to FIG. 2 except showing the handle replaced by a force air pipe when normal atmospheric air is insufficient for decarbonizing the coke oven flue walls.

Referring more particularly to FIG. 1 of the drawing, numeral 1 denotes a fragmentary part of a gas manifold pipe, such as found along one side of a coke oven, it being understood that there is also a manifold extending along the other side together with feeder pipes and regulators as illustrated in FIG. 1. It is common to have 50 to 60 feeder pipes on each side of the batteries of coke ovens. While the invention is described as applied to a coke oven, it is suitable for other similar applications, as well.

Gas fed into manifold 1 is led to a plurality of the regulating assemblies and then into a plurality of gas feeding pipes 2 which are led to burners in the coke oven batteries.

More specifically, gas from the manifold 1 is led into a plurality of pipes 3 which lead to shut-off valves 4, thence to three-way valves 5 whose position is varied by turning of a handle 6, preferably by a gang operated reversing rod 7 so as to move the three-way valves either to the air introducing position, showing in FIG. 4*a* for decarbonizing the wall, or to the gas introducing position shown in FIG. 4*b* for introducing gas to the burner.

Figure 3:
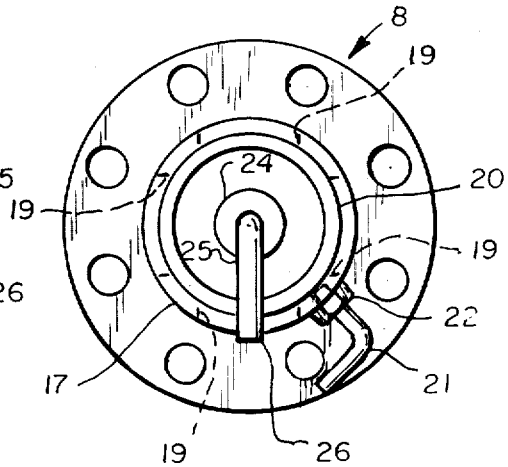
FIG. 3 is an end view, as viewed from the left of FIG. 2, of the air regulating assembly.

Numeral 8 in FIGS. 1,2 and 3 generally denotes the air regulating assembly embodying the present invention. The three-way valve body 9 of FIGS. 4*a*, 4*b* has a flange which is coupled to a flange 18 of the valve regulating assembly. Turning of the valve plug 10 to various positions will determine whether air or gas is fed into the burners, as illustrated in FIGS. 4*a* and 4*b*.

A pipe 17, such as a 4 inch pipe, is provided with a pair of diametrically opposite holes 19, 19, which are preferably staggered in relationship to another pair of diametrically opposite holes 19, 19, as best illustrated in FIG. 2, so as to obtain optimum progressive introduction of outside air, such as illustrated in the chart shown in FIG. 5, wherein air introduction, in percentage of opening through holes 19, is plotted against longitudinal movement or adjustment, in inches, axially of pipe 17.

Such adjustment is provided by a slidable sleeve 20 which can be longitudinally adjusted so that its edge can selectively close off any percentage of the opening of the four holes 19 to adjust the amount of air intake from the surrounding atmosphere. When the proper adjustment is obtained, a locking device 21 is turned so that its end tightly engages the external surface of sleeve 20 and may be locked in the adjusted position. Nut 22 is welded to pipe 17.

At the outer end of sleeve 20, there is integrally secured, such as by welding, an end plate 23 or "cookie" as often referred to in the trade. A central hole 24 is threaded therein, into which is screwed a correspondingly threaded end portion of an angle shaped handle 25 terminating in an end portion 26 which serves as a stop against the outer edge of pipe 17 to prevent abnormal insertion of sleeve 20 into pipe 17 which would be difficult to retrieve. If desired, end portion 26 of the handle may also be so positioned relative to the outer edge of pipe 17 (or any projection therefrom) as to determine the normal amount of opening of holes 19. The outer surface of sleeve 20 may be calibrated, if so desired, to denote the extent of opening adjustment of holes 19. The staggered relationship of the pairs of holes 19, 19 provides an ideal substantially straight line relationship between longitudinal movement and percentage opening, as shown in FIG. 5.

FIG. 6 shows a modification of the structure shown in FIG. 2 for introducing forced air, wherein the only difference is that sleeve 20 is rigidly secured to pipe 17 such as by weld 27 — also handle 25 is unscrewed and replaced by pipe 28 carrying forced air. Pipe 28 is screw threaded into the same hole as handle 25, thereby requiring no replacement of the sleeve or other parts.

In operation, when it is desired to vary the amount of air from the surrounding atmosphere introduced through holes 19, handle 25 is grasped and pulled so as to move sleeve 20 selectively longitudinally when it is desired to vary the percentage of exposed openings of holes 19. Thereafter, locking device 21 is tightened so as to lock sleeve 20 to pipe 17 in the adjusted position. By proper turning of the three-way valve 5 to various positions, such as shown in FIGS. 4*a* or 4*b*, either air or gas is fed into the burner depending upon whether decarbonation of the flue or feeding of gas to the burner is desired, relating to the specific cycle of the coke oven.

When forced air is desired to be introduced, handle 25 is unscrewed and replaced by pipe 28 (FIG. 6) through which forced air from any suitable source is provided.

It should be noted that holes 19 may be provided both in sleeve 20 and in pipe 17 to allow both sliding and turning.

Thus it will be seen that we have provided a coke oven air regulating assembly which is of relatively low cost, as compared to presently used assemblies, and which can be very speedily adjusted for different amounts of air required by very quick, relative sliding movement between sleeve and pipe, which sliding movement is limited by abutment of the handle against the end of the pipe — also which assembly is very easy and inexpensive to manufacture, eliminating the need for forming large diameter threads in either the sleeve or surrounding pipe; also which can be very simply converted to a forced air system simply by unscrewing the handle and replacing it by a forced air inlet pipe.

While we have illustrated and described several embodiments of our invention, it will be understood that these are by way of illustration only and that various changes and modifications may be contemplated in our invention and within the scope of the following claims.

We claim:

1. In a coke oven battery having a manifold pipe feeding gas to a plurality of three-way valves connected to inlet pipes leading to gas burners of said coke oven battery, an air regulating assembly comprising a pipe connected to each of said three-way valves, said pipe including a plurality of holes, a sleeve longitudinally slidable relative to the free end portion of said pipe so that the inner end of said sleeve selectively adjusts the extent of opening of said holes so as to admit selective amounts of outside air into said pipe, an end plate closing the outer end of said sleeve, and a handle attached to said end plate to enable manual longitudinal sliding movement of said sleeve relative to said pipe.

2. Apparatus as recited in claim 1 wherein said holes are longitudinally staggered, and wherein a locking means is provided for locking said sleeve relative to said pipe in any adjusted position.

3. Apparatus as recited in claim 1 wherein said handle is substantially L shaped and has a screw threaded end portion which is screw threaded to a threaded hole in said end plate and has a handle portion extending at right angle and terminating beyond the circumference of said pipe so as to serve as a limit stop, by abutting against the end of said pipe, to prevent abnormal insertion of the sleeve inside said pipe.

4. Apparatus as recited in claim 1 wherein said handle is removed and replaced by a pipe carrying air under pressure.

* * * * *